US007017323B2

(12) United States Patent
Sobel

(10) Patent No.: US 7,017,323 B2
(45) Date of Patent: Mar. 28, 2006

(54) PACKAGING MACHINE

(75) Inventor: Ralf Sobel, Haan/Gruiten (DE)

(73) Assignee: Cyklop GmbH, Cologne (DE)

( * ) Notice: Subject to any disclaimer, the term of this patent is extended or adjusted under 35 U.S.C. 154(b) by 0 days.

(21) Appl. No.: 10/484,276

(22) PCT Filed: May 22, 2002

(86) PCT No.: PCT/EP02/05599

§ 371 (c)(1),
(2), (4) Date: Jul. 2, 2004

(87) PCT Pub. No.: WO03/008271

PCT Pub. Date: Jan. 30, 2003

(65) Prior Publication Data

US 2004/0237467 A1 Dec. 2, 2004

(30) Foreign Application Priority Data

Jul. 18, 2001 (DE) ..... 101 34 257

(51) Int. Cl.
*B65B 41/12* (2006.01)

(52) U.S. Cl. ..... 53/389.3; 226/118.1

(58) Field of Classification Search ..... 53/389.3, 53/465, 466, 141; 226/118.1, 118.2, 121, 226/120

See application file for complete search history.

(56) References Cited

U.S. PATENT DOCUMENTS

| | | | | |
|---|---|---|---|---|
| 2,346,194 | A * | 4/1944 | Sjostrom | 53/389.3 |
| 3,078,023 | A * | 2/1963 | Hecker | 226/118.1 |
| 3,611,028 | A * | 10/1971 | Whitmore | 492/56 |
| 3,757,164 | A * | 9/1973 | Binkowski | 361/212 |
| 4,058,426 | A | 11/1977 | Pasic et al. | |
| 4,319,443 | A * | 3/1982 | Watts, Jr. | 53/466 |
| 4,484,926 | A * | 11/1984 | Atlas | 526/317.1 |
| 5,189,865 | A * | 3/1993 | Andrade et al. | 53/466 |
| 5,534,192 | A * | 7/1996 | Incorvia et al. | 252/500 |
| 5,981,066 | A * | 11/1999 | Gabbay | 428/389 |
| 6,223,500 | B1 * | 5/2001 | Kramps | 53/466 |

FOREIGN PATENT DOCUMENTS

| | | |
|---|---|---|
| DE | 41 03 000 A1 | 8/1992 |
| EP | 1 050 459 A | 11/2000 |

* cited by examiner

*Primary Examiner*—Louis Huynh
(74) *Attorney, Agent, or Firm*—Fay Sharpe Fagan Minnich & McKee; Brian E. Turung; Robert V. Vickers

(57) ABSTRACT

A packaging machine for wrapping packing pieces with packing film. The packing machine includes a transport device for the packing pieces arranged in a transport channel, at least one pulling device for the packing film and a film cutting and welding device which, when operated, pulls one film section from the pulling device and welds it to another film section for forming a film tube surrounding the packing piece. The packing machine is design to prevent a run-up of the film pulled by the pulling device into the transport channel by the inclusion of a narrow through gap for the packing film. The gap limits the passage of the film when the tension on the film is reduced.

37 Claims, 3 Drawing Sheets

PACKAGING MACHINE

The present invention claims priority on co-pending International Patent Publication No. WO 03/008271 filed on May 22, 2002, which in turn claims priority on German Patent Application Serial No. 101 34 257.8 filed on Jul. 18, 2001.

The present invention relates to a packaging machine for the wrapping of packing pieces with packing film. The present invention is more particularly related to a packaging machine having a transport device for the packing pieces, at least one pulling device for the packing film, and a packing film cutting and connecting device.

BACKGROUND OF THE INVENTION

Packaging machines for the wrapping of packing pieces with plastic film are often used for the packing of newspapers and magazines. The newspapers and magazines are typically guided through the transport channel by means of the transport device in packs of different heights or as a single copy.

The plastic film is generally pulled from two rolls, one of which is arranged below the transport device, and the other one above. The plastic films are welded or connected approximately at the height of the transport device. As a result, the plastic films form a closed web or film wall running transversely to the transport direction of the packing pieces (e.g., newspapers and magazines). The plastic film from the lower roll applies itself from below and between the transport device as the packing pieces move against the plastic film from the lower roll. The upper roller guides the plastic film to be deposited around the front face and the upper side of the packing pieces. The wrapped packing pieces are then guided to the transport device with the help of the film cutting and welding or connecting unit descending from above in the direction of the transport band. The plastic film from the upper roller is welded or connected to the plastic film from the lower roller by two parallel weld seams and the plastic films are then cut between the two weld seams. The packing piece which is wrapped in such a manner with a circulating film tube at its front and back face, and its upper and lower side, is subsequently ejected by the transport device.

While the plastic film is pulled comparatively slowly at its front face and upper side during the wrapping of the packing piece from above with only a little more than the transport velocity of the packing piece, it experiences a large acceleration when the film cutting and welding unit is actuated for closing of the film tube at the backwardly arranged face and takes along the film supplied from above during its fast downward movement in the direction of the transport band. During the comparatively sudden standstill of the film cutting and welding unit, the film pulled from above from the pulling unit tends to run-up due to its inherent momentum and tends to deposit itself in the transport channel for the packing pieces in waves of excess material instead, as desired, to stand as a largely flat vertical film wall after the welding to the packing piece which is supplied from below. The transport channel is thereby blocked very quickly and operation disruptions result, so that an orderly wrapping of the packing pieces cannot be ensured and a frequent standstill of the machine results.

In the past, the problem of the undesired film run-on was met by comparatively elaborate mechanical devices which were controlled in dependence of the movement of the film cutting and welding unit so as to decelerate the film synchronously with the film cutting and welding unit. It has for example been suggested to provide a brush ledge which can be lined up against the film and to press it against a support, which ledge is arranged in the machine flame in a pivoted manner and which is pressed against the film by a drive, when the film cutting and welding unit decelerates during the approach to its lowest position, so that the momentum inherent to the film is cancelled by this friction brake. This arrangement is comparatively elaborate and error-prone.

In view of the present state of technology with respect to wrapping machines, there is a demand for a plastic wrapping machine that reliably and efficiently wraps packing pieces and minimizes waste of plastic film during the wrapping process without the use of elaborate and/or complex mechanical arrangements.

SUMMARY OF THE INVENTION

In accordance with the present invention, there is provided a packaging machine that is design to wrap packing pieces with packing film. The packing film is typically a plastic film such as polyethylene (e.g., LDPE, LLDPE, MDPE, HDPE, etc.); however, other types of packing films can be used. The packing machine is designed to inhibit or to prevent the run-up of packing film into a transport channel during the wrapping of the packing pieces. The packing machine includes a transport device for the packing pieces that are arranged in a transport channel. The packing machine also includes at least one pulling device for the packing or packing film and a packing film cutting and a packing film connecting or welding device. The welding device is designed to pull one packing film section from at least one of the pulling devices and to weld or connect the one packing film section to another packing film section that forms a packing film tube which surrounds the packing piece. The pulling device of the packing machine on the pulling side facing the packing film cutting and welding device includes a narrow through gap for the packing film. The narrow gap is used to inhibit or prevent a run-up of the packing film that is pulled by the pulling device into the transport channel. When the welding device ceases to pull on the packing film during the sealing or connecting operation, the packing film is thrown against the passage through the gap as a result of the inherent momentum without being able to pass though the gap into the transport channel. As a result, excess packing film does not accumulate in the transport channel.

In another aspect of the present invention, the packing film is pulled through a narrow gap which lets the packing film pass in an unimpeded manner when the film cutting and welding device exerts a traction force on the packing film; however, the narrow gap effectively inhibits the further passage of packing film when the traction force of the film cutting and welding device on the packing film decreases and the packing film has the inclination, as a result of its inherent momentum, to move further in the pulling direction. As the packing film continues to move in the pulling direction after the decrease in force from the cutting and welding device, the packing film forms folds or waves in front of the gap due to the absence of rigidity or tension on the packing film. The fold in the packing film abuts the upper and/or lower boundary of the gap, thus the packing film does not proceed further through the comparatively narrow gap. As a result, excess film does not enter or reach the transport channel. The packing machine of the present invention thus does not prevent the run-up of the packing film after the tension on the packing film caused by the cutting and welding device decreases; however, the design of the packing machine effectively prevents packing film which runs up after the tension decrease from reaching the transport channel for the packing pieces by blocking such packing film.

In another and/or alternative aspect of the present invention, at least one of the pulling devices of the packing machine includes a packing film buffer. The film buffer is designed to support the accumulated packing film which is inhibited or prevented from proceeding through the gap. The film buffer is designed to allow the packing film to pass over the film buffer with minimal friction so as not to interfere with the movement of the packing film as it is drawn through the gap. In one embodiment, the film buffer includes a flexible material. In one aspect of this embodiment, the film buffer is primarily formed of a flexible antistatic material. One non-limiting material that can be used is linen cloth. The use of a antistatic material prevents or reduces the occurrences of the packing film forming an electrostatic charge as the packing film passes over the film buffer. The buildup of static charge on the packing film can result in adhesion forces on the packing film which can complicate or interfere with the desired a pulling of the film from and/or through the gap.

In still another and/or alternative aspect of the present invention, the packing machine can include a reversing ledge position near the gap. The reversing ledge is designed to facilitate in causing the packing film that has passed through the gap to change directions.

In yet another and/or alternative aspect of the present invention, the through gap is typically is defined upwardly and/or downwardly by a stop ledge for the packing film. During the decrease of the traction force exerted on the film when the cutting and welding device decreases the pulling force on the packing film, the packing film loops in front of the gap and abuts against a stop ledge, where the inherent momentum of the packing film is reduced or eliminated. In one embodiment of the invention, the gap is defined by a film support and the stop ledge. The front face of the stop ledge that faces the packing film as the packing film enters the gap is gap generally at a right angle to the packing film passing through the gap. When a film support is used, the front face of the stop ledge is also generally at a right angle to the top surface of the film support that is closely adjacent to the gap.

In still yet another and/or alternative aspect of the present invention, the film support is inclined with an angle of about 15–45° to the horizontal in the pulling region of the packing film. This incline allows the film to glide on the inclined plane of the film support in a direction away from the through gap after the packing film has lost its momentum when the cutting and welding device decreases the pulling force on the packing film and the excess packing film is inhibited or prevented from passing through the gap. As a result, the incline helps to prevent the gap from being covered by the film which lies in loops or folds immediately in front of the gap, thereby inhibiting or preventing complication from the later pulling of the packing film through the gap.

In a further and/or alternative aspect of the present invention, the gap thickness of the through gap can be adjusted. The adjustment of the gap can be accomplished by many arrangements. One non-limiting arrangement is by the use of adjustment screws that are used to move the stop ledge so as to change the distance from the base ledge. It is thus possible to adjust the gap width optimally for different films being used in the machine which vary in flexibility due to their different thickness and/or material composition.

In still a further and/or alternative aspect of the present invention, the film support can be connected to the base ledge to limit the through gap downwardly. The stop ledge is typically arranged in a pivoted or detachable manner for opening the through gap, so that the film does not have to be threaded laboriously into the gap such as during the insertion of a new film roll into the machine. This arrangement of the stop ledge enables the packing film to be inserted into the open gap after pivoting or detaching the stop ledge, before the stop ledge is attached or pivoted again so as to limit the gap upwardly.

In yet a further and/or alternative aspect of the present invention, the reversing ledge can be adjusted with regard to the through gap in its distance and/or its alignment. The reversing ledge is conveniently arranged at the stop ledge and can be detached or pivoted together therewith, or also separately, for insertion of film.

In still yet a further and/or alternative aspect of the present invention, the through gap has a gap width which at least corresponds to about 1.1 times or double the film thickness. The packing film that runs through the gap has sufficient clearance and is securely pulled through the gap without undue force, or without friction forces occurring in the gap to a noteworthy extent so as not to counteract the traction force exerted on the film. The gap width of the through gap is conveniently about 0.2–1 mm which has been proven as a reliable gap measure with the films having film thicknesses of about 10–80 μm.

In summary, the packaging machine for wrapping packing pieces with packing film in accordance with the present invention typically includes 1) a transport device for the packing pieces which are arranged in a transport channel, 2) at least one pulling device for the packing film and 3) a film cutting and welding or connecting device. The at least one pulling device typically includes a narrow through gap for the packing film. The gap is limited from above and below and is arranged at the pulling side of the pulling device facing the film cutting and welding device. The packaging machine also can include at least one pulling device having a film buffer which is upstream of the through gap. The packaging machine further can include a reversing ledge that is arranged downstream of the through gap. The packaging machine still further can include a film buffer that includes a film support of flexible antistatic material. The packaging machine also can include a film support that includes linen cloth. The packaging machine still also can include a through gap that is limited above and/or below by a stop ledge for the packing film. The packaging machine further can include a stop ledge that is arranged at the pulling side end region of the film support above the film support and at approximately a right angle thereto. The packaging machine also can include a film support that is inclined at an angle of about 15–45° with regard to the horizontal in the pulling region of the packing film. The packaging machine still further can include an adjustable through gap. The packaging machine also can include a film support that is connected to a base ledge, and the base ledge limits the through gap from below. The packaging machine still also can include a stop ledge that is arranged in a pivoting or demountable manner for opening the through gap. The packaging machine further can include a reversing ledge that can be adjusted with regard to the through gap in its distance and/or its alignment. The packaging machine can still further include a reversing ledge that is arranged at the stop ledge. The packaging machine can also include a reversing ledge that is arranged in a pivoting or demountable manner. The packaging machine still also can include a through gap that comprises a gap width of about 0.2–1 mm.

It is the object of the invention to develop a packaging machine of the abovementioned type its such a manner that a run-up of the film into the transport channel is avoided in a reliable manner without the need for elaborate mechanical devices. This object is solved by means of the invention in that the pulling device comprises a narrow through gap for the packing film which gap is defined upwardly and downwardly at the pulling side facing the film cutting and welding device.

These and other objects and advantages will become apparent from the discussion of the distinction between the invention and the prior art and when considering the preferred embodiment as shown in the accompanying drawings.

BRIEF DESCRIPTION OF THE INVENTION

Figure 1:
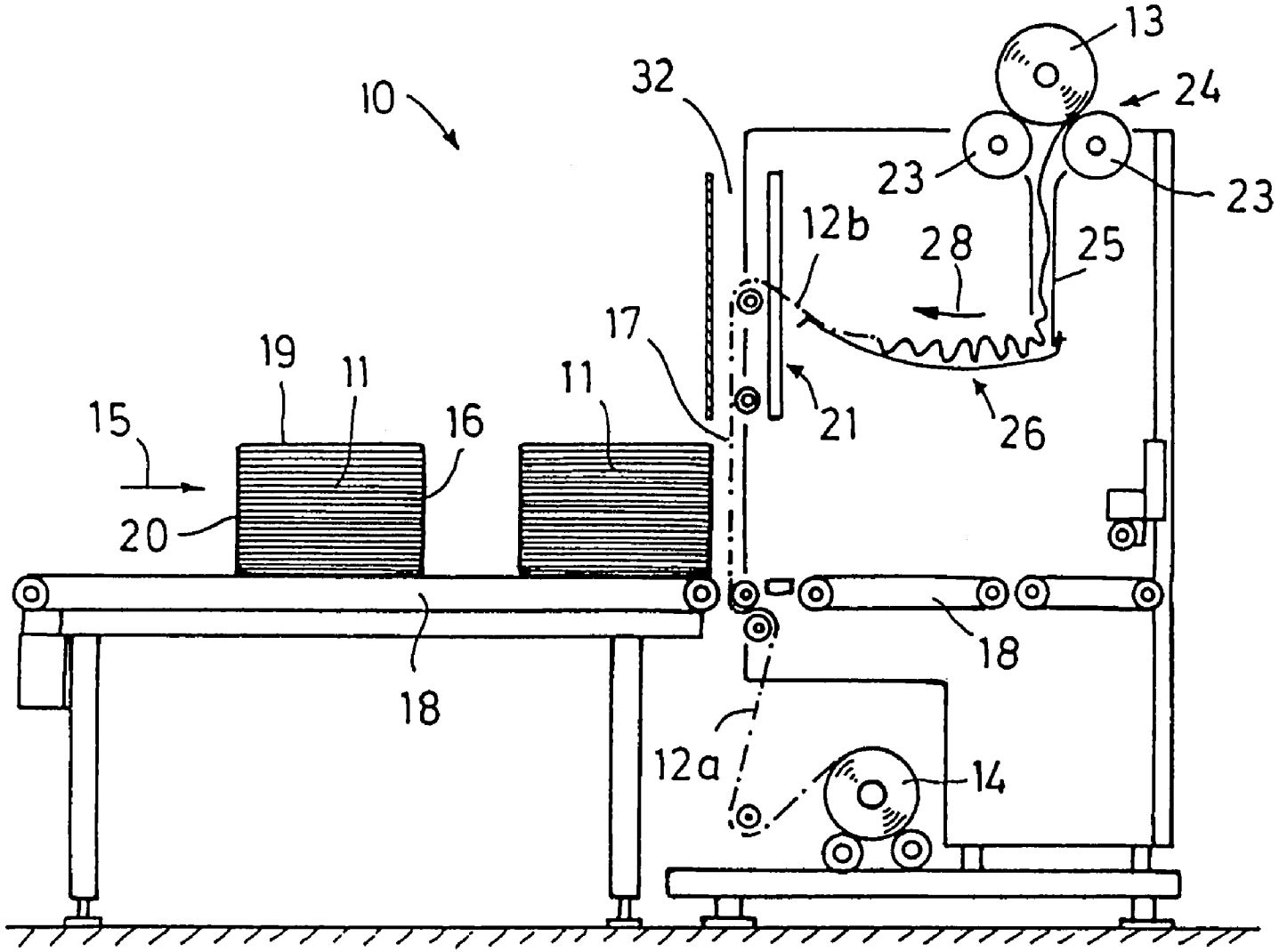
FIG. 1 is a side elevation view of a packaging machine in accordance with the invention.

Referring now in greater detail to the drawings, wherein the showings are for the purpose of illustrating preferred embodiments of the invention only, and not for the purpose of limiting the invention, FIG. 1 illustrates a packaging machine 10 for wrapping newspaper packs 11 with a packing film 12, so that the newspapers are protected from water and dirt during further transport. The packing machine will be described in detail with respect to the wrapping of newspapers; however, it will be appreciated that other materials can be wrapped by the packing machine of the present invention.

The packing film, which is typically a plastic wrapping film, is pulled from an upper roll 13 and a lower roll 14 in two sections 12*a*, 12*b* in an essentially known manner, whereby the film sections 12*a, b* are connected to one another after diverse deflections in the machine frame to a clamped film wall 17 running generally transversely to the transport direction 15 of the packing pieces 11. The newspaper packs 11 to be packed lie on a transport band 18 and run with face 16 against the film wall 17 during their transport and take these along, so that the film section 12*a* supplied from below deposits itself between the transport band 18 and the lower side of the pack 11, while the film section supplied from above covers the front face 16 and the upper side of the newspaper pack 11.

Figure 2:
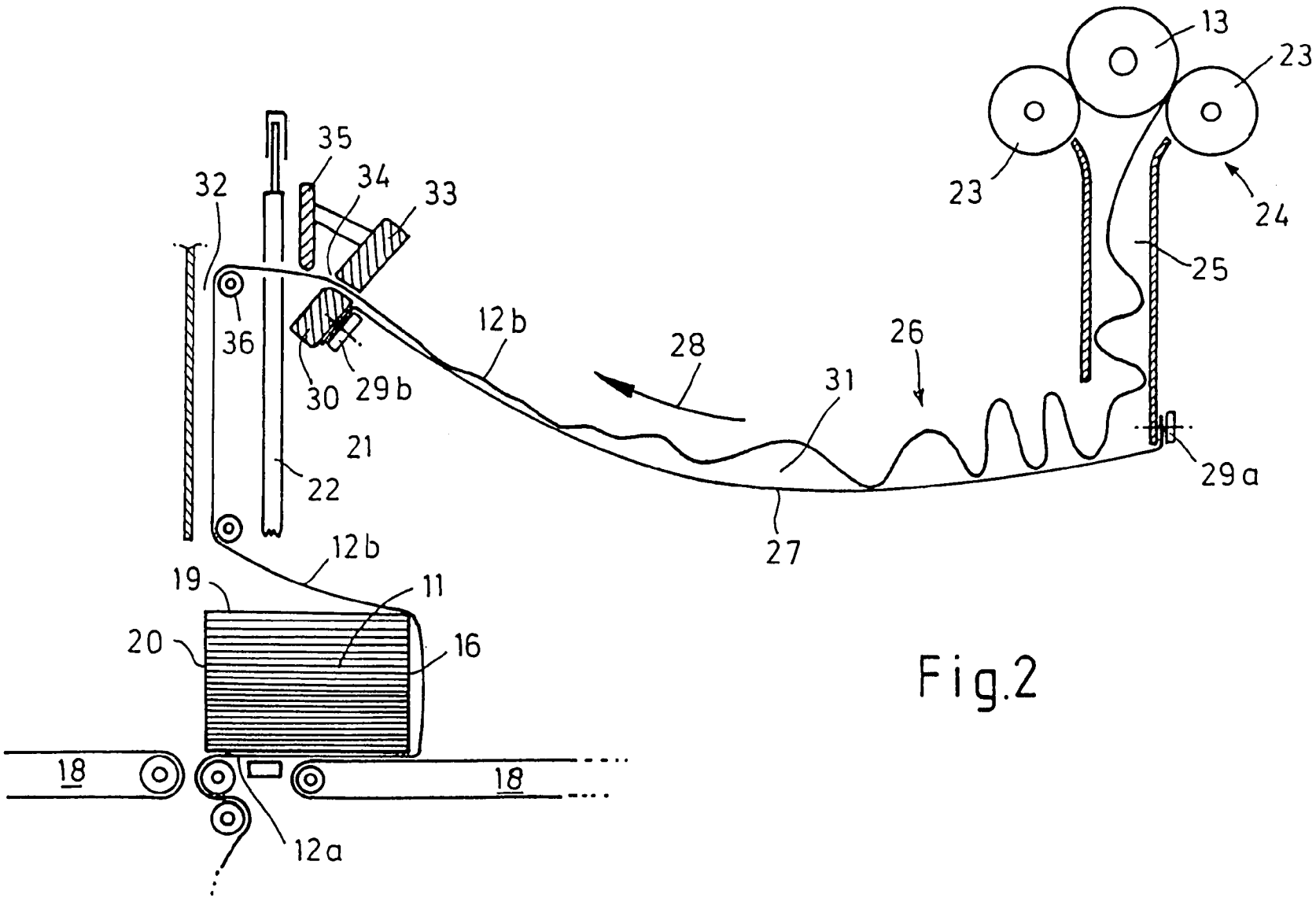
FIG. 2 is an enlarged schematic view of a portion of the packing machine of FIG. 1.

So as to also cover the backside face 20 with film, and to create hereby a closed film tube surrounding the pack at its four sides, the machine is provided with a film cutting and welding unit 21 which comprises a welding knife 22 which is moveable in a vertical direction in the machine frame. This arrangement is best shown in FIG. 2. After a newspaper pack has passed under the welding knife, the knife is moved downwardly in the direction of the transport band and thereby takes along the upper film section 12*b* so as to weld it to the lower film section 12*a* with two parallel weld seams and to separate the two sections between the weld seams, so that the complete wrapped packing piece can be transported further and a new film wall 17 develops in front of the next packing piece. The welding and/or cutting process can be fully mechanical or can include the use of heat.

For the pulling of the film piece 12*b* supplied above, the upper film roll 13 is received in a pulling device 24 comprising two parallel pulling rollers 23, whereby one of the pulling off rollers can be rotated by a drive (not shown), whereby the film is taken off the roll 13 and reaches a film buffer 26 assigned to the pulling device 24 through a pulling off chute 25. This film buffer 26 essentially consists of a flexible antistatic film support 27 of linen cloth, which is secured to the rearward chute wall of the pulling chute with a first clamping ledge 29*a* with the front end in the passing direction 28 of the film. The film support is clamped to a base ledge 30 arranged in the machine frame transversely to the transport direction 15 of the packing pieces 11 with its rear end in the passing direction 28. The arrangement is made in such a manner that the linen cloth is arranged in a sagging manner, so that the film positioned in the film buffer in a wave or loop-like manner which is buffered in the film buffer tends to glide into the center part 31 of the linen cloth.

By the welding knife 22 moving downward with a comparatively fast velocity, the film supplied from above is also pulled from the film buffer with a large velocity until the welding knife is braked by its servo drive (not shown) during the approach to the transport band 18 and is stopped for a short time for the execution of the welding and cutting operation. As such, during the braking of the knife, the thin flexible film is not braked simultaneously. The movement momentum inherent in the film remains, thus the film 12*b*, which is at the same time set in motion during the downward movement of the knife 22, has the inclination to flow further from the film buffer 26 in spite of the delay of the knife. As such, the film supplied from above further flows unintentionally and blocks the transport channel 32 formed above the transport band 18 in the region of the film cutting and welding unit 21. A proper wrapping of the following packing pieces 11 would then not be ensured.

In order to prevent this behavior of the upper film, the pulling device 24 comprises a narrow through gap at the run-out end of its film buffer which is limited by a base ledge at the bottom end and a stop ledge 33 at the upper end, through which gap is guided the packing film 12*b* which is fed from above. A reversing ledge 35 which is arranged at the stop ledge 33 and downstream of the through gap guides the film a little bit downwards after its exit from the gap 34 before it reaches the transport channel 32 by means of a reversing rod 36.

Figure 3:
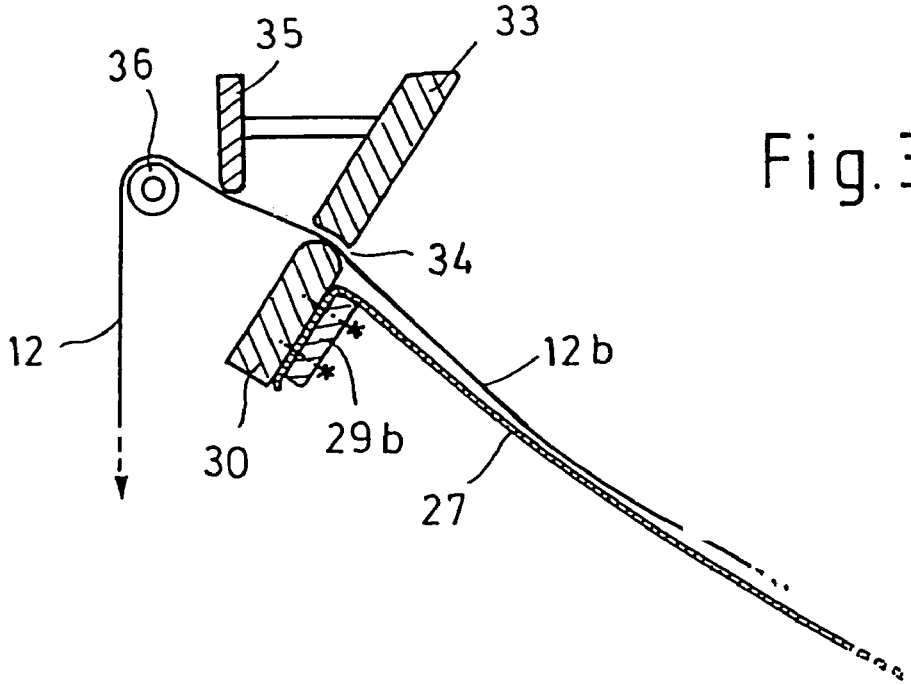
FIG. 3 is a cross-sectional view of the region of the through gap of the pulling device of the packaging machine in a first operating position.
Figure 4:
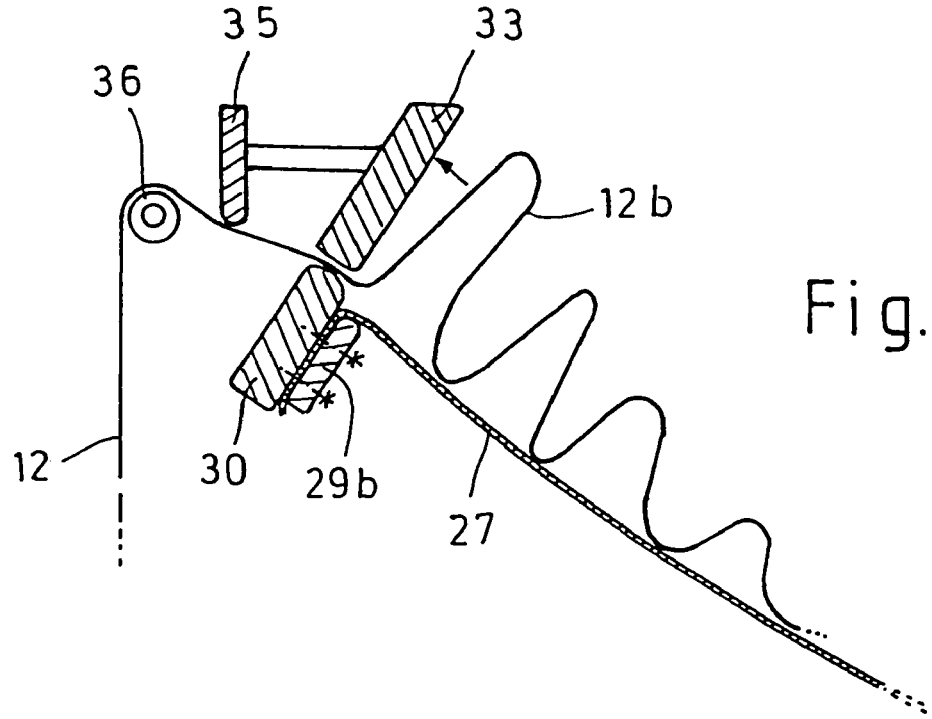
FIG. 4 is a cross-sectional view of the region of the through gap of the pulling device of the packaging machine in a second operating position.

As can easily be seen from FIGS. 3 and 4, the though gap 34 effectively prevents that the packing film from the film buffer reaches the transport channel 32, as soon as the downward movement of the welding knife 22 is stopped and this therefore does not pull at the film anymore. As long as the knife moves downwards, it pulls the film from the film buffer with the same velocity through the gap 34 as shown in FIG. 3. When the pulling movement stops, the movement momentum inherent to the film has the inclination to see to a further movement of the film in the same direction. However, due to the high flexibility or instability of the film, an accumulation of the film in front of the through gap results as shown in FIG. 4. In other words, the movement momentum of the film is not in the position to push this through the comparatively narrow gap, but the movement energy of the film is destroyed by positioning it in loops and abutting the stop ledge 33. An undesired further flow of film from the gap into the transport channel is thereby effectively prevented.

In practice, the gap 34 has a gap width of about 0.2 to 1 mm, whereby it is safely ensured that the film can be taken off the downwardly moving welding knife from the film buffer in a practically frictionless manner, but cannot be pushed through the gap by the movement momentum of the film moved within the film buffer. The gap width can be adjustable for the adaptation to different film qualities and widths which can for example be achieved in a simple manner in that the stop ledge is received in a displaceable manner in approximately U-shaped guides arranged at the base ledge 30 with its ends and its distance from the base ledge can be adjusted by adjustment screws. In a similar manner, the height position of the reversing ledge can also be variable.

In order to ensure an easy insertion of the film in the through gap for example during the change of the roll 13, the stop ledge and the reversing ledge can be entirely demounted or pivoted upwards, so that the film end to be newly inserted can simply be deposited on the base ledge from above and then the stop ledge and the reversing ledge are again brought into their operating position for forming the narrow gap.

The invention is not limited to the shown and described embodiment, but various changes and additions are feasible without leaving the scope of the invention. It is, for example, possible to not form the film buffer in the described, particularly advantageous manner as a simple linen cloth, on which the packing film is buffered in loops. The buffer can also be formed by several axially parallel reversing rolls part of which is arranged in a movable manner is known. The angle of inclination of the stop, reversing and/or base ledge can be adjustable so as to change the pulling angle of the film from the through gap and thereby to ensure a run-up of the packing films even with comparatively rigid films against the stop ledge practically at the same time as the welding knife does not move downward and thereby does not pull the film.

The invention claimed is:

1. A packaging machine for wrapping packing pieces which inhibits run-up of packing film into a transport channel during the wrapping of said packing pieces with said packing film comprising a transport device to transport said packing pieces in a transport channel to a wrapping location, an upper and lower packing film delivery arrangement, a film cutting and welding device to at least partially cut said packing film at said wrapping location and to at least partially weld said packing film together after said packing film has been at least partially wrapped about one of said packing pieces, said upper and lower packing film delivery arrangement each including at least one source of packing film and at least one guide arrangement to guide each of said packing films to said wrapping location, said upper packing film delivery arrangement including a pre-set narrow gap, said narrow gap positioned upstream from said transport channel and having a size to at least partially control passage of said packing film through the narrow gap and to said wrapping location thereby at least partially inhibiting run-up of said packing film into said transport channel after said packing piece has been at least partially wrapped, said narrow gap having a pre-set size that is larger than a thickness of said wrapping film.

2. The packaging machine as defined in claim 1, wherein said narrow gap has a size of at least about 1.1 times the thickness of said packing film.

3. The packaging machine as defined in claim 2, wherein said gap size is up to about 2 times the thickness of said packing film.

4. The packaging machine as defined in claim 3, including a packing film buffer positioned between said source of packing film and said narrow gap, said packing film buffer designed to at least partially support packing film that has accumulated between said narrow gap and said source of packing film, said packing film buffer is at least partially formed of a flexible antistatic material.

5. The packaging machine as defined in claim 4, wherein said packing film buffer includes linen cloth.

6. The packaging machine as defined in claim 4, wherein said packing film buffer is non-planar, said packing film buffer including an incline of an angle of about 15–45°.

7. The packaging machine as defined in claim 5, wherein said packing film buffer is non-planar, said packing film buffer including an incline of an angle of about 15–45°.

8. The packaging machine as defined in claim 7, said upper packing film delivery arrangement includes a chute that guides said packing film downwardly from said source of packing film to said packing film buffer.

9. The packaging machine as defined in claim 8, said upper packing film delivery arrangement includes a reversing ledge designed to at least partially cause said packing film to change direction after said packing film has passed through said narrow gap.

10. The packaging machine as defined in claim 9, wherein a width of said narrow gap is adjustable.

11. The packaging machine as defined in claim 10, wherein said upper packing film delivery arrangement includes a transport channel to guide said packing film downwardly to said wrapping location after said packing film has passed through said narrow gap.

12. The packaging machine as defined in claim 2, wherein a width of said narrow gap is adjustable.

13. The packaging machine as defined in claim 2, wherein said upper packing film delivery arrangement includes a transport channel to guide said packing film downwardly to said wrapping location after said packing film has passed through said narrow gap.

14. The packaging machine as defined in claim 2, including a packing film buffer positioned between said source of packing film and said narrow gap, said packing film buffer designed to at least partially support packing film that has accumulated between said narrow gap and said source of packing film, said packing film buffer is at least partially formed of a flexible antistatic material.

15. The packaging machine as defined in claim 14, wherein said packing film buffer is non-planar, said packing film buffer including an incline of an angle of about 15–45°.

16. The packaging machine as defined in claim 14, said upper packing film delivery arrangement includes a chute that guides said packing film downwardly from said source of packing film to said packing film buffer.

17. The packaging machine as defined in claim 1, wherein said gap size is up to about 2 times the thickness of said packing film.

18. The packaging machine as defined in claim 1, including a packing film buffer positioned between said source of packing film and said narrow gap, said packing film buffer designed to at least partially support packing film that has accumulated between said narrow gap and said source of packing film, said packing film buffer is at least partially formed of a flexible antistatic material.

19. The packaging machine as defined in claim 18, wherein said packing film buffer includes linen cloth.

20. The packaging machine as defined in claim 18, wherein said packing film buffer is non-planar, said packing film buffer including an incline of an angle of about 15–45°.

21. The packaging machine as defined in claim 18, said upper packing film delivery arrangement includes a chute that guides said packing film downwardly from said source of packing film to said packing film buffer.

22. The packaging machine as defined in claim 1, said upper packing film delivery arrangement includes a reversing ledge designed to at least partially cause said packing film to change direction after said packing film has passed through said narrow gap.

23. The packaging machine as defined in claim 1, wherein a width of said narrow gap is adjustable.

24. The packaging machine as defined in claim 1, wherein said upper packing film delivery arrangement includes a transport channel to guide said packing film downwardly to said wrapping location after said packing film has passed through said narrow gap.

25. A packaging machine for wrapping packing pieces which inhibits run-up of packing film into a transport channel during the wrapping of said packing pieces with said packing film comprising a transport device to transport said packing pieces in a transport channel to a wrapping location, an upper and lower packing film delivery arrangement, a film cutting and welding device to at least partially cut said packing film at said wrapping location and to at least partially weld said packing film together after said packing film has been at least partially wrapped about one of said packing pieces, said upper and lower packing film delivery arrangement each including at least one source of packing film and at least one guide arrangement to guide each of said packing films to said wrapping location, said upper packing film delivery arrangement including a packing film buffer and a pre-set narrow gap, said packing film buffer positioned between said source of packing film and said narrow gap, said packing film buffer designed to at least partially support packing film that has accumulated between said narrow gap and said source of packing film, said packing film buffer being at least partially formed of a flexible antistatic material, said packing film buffer being non-planar and having an incline of an angle of about 15–45° said narrow gap positioned upstream from said transport channel and having a size to at least partially control passage of said packing film through the narrow gap and to said wrapping location thereby at least partially inhibiting run-up of said packing film into said transport channel after said packing piece has been at least partially wrapped, said narrow gap having a pre-set size that is greater than a thickness of said packing film and being up to about 2 times a thickness of said packing film.

26. The packaging machine as defined in claim 25, said upper packing film delivery arrangement includes a chute that guides said packing film downwardly from said source of packing film to said packing film buffer.

27. The packaging machine as defined in claim 26, wherein said upper packing film delivery arrangement includes a transport channel to guide said packing film downwardly to said wrapping location after said packing film has passed through said narrow gap.

28. The packaging machine as defined in claim 27, said upper packing film delivery arrangement includes a reversing ledge designed to at least partially cause said packing film to change direction after said packing film has passed through said narrow gap.

29. The packaging machine as defined in claim 28, wherein a width of said narrow gap is adjustable.

30. The packaging machine as defined in claim 29, wherein said upper packing film delivery arrangement includes a transport channel to guide said packing film downwardly to said wrapping location after said packing film has passed through said narrow gap.

31. The packaging machine as defined in claim 25, wherein said upper packing film delivery arrangement includes a transport channel to guide said packing film downwardly to said wrapping location after said packing film has passed through said narrow gap.

32. The packaging machine as defined in claim 25, said upper packing film delivery arrangement includes a reversing ledge designed to at least partially cause said packing film to change direction after said packing film has passed through said narrow gap.

33. The packaging machine as defined in claim 25, wherein a width of said narrow gap is adjustable.

34. The packaging machine as defined in claim 25, wherein said upper packing film delivery arrangement includes a transport channel to guide said packing film downwardly to said wrapping location after said packing film has passed through said narrow gap.

35. A packing machine for wrapping packing pieces with packing film, said packaging machine comprising:

a transport channel;

a transport device for transporting said packing pieces in said transport channel;

a cutting and welding device for cutting and welding said packing film; and, at least one pulling device for said packing film, said pulling device including a pre-set narrow gap for passage of said packing film, said narrow gap being limiting above and below by ledges, at least one of said ledges being a stop ledge for said packing film, said narrow gap arranged at a pulling side of said pulling device, said narrow gap having a pre-set size that is greater than a thickness of said packing film, said pulling side being arranged towards said film cutting and welding device.

36. The packaging machine as defined in claim 35, including a packing film buffer positioned between a source of packing film and said narrow gap, said packing film buffer designed to at least partially support packing film that has accumulated between said narrow gap and said source of packing film, said packing film buffer is at least partially formed of a flexible antistatic material.

37. The packaging machine as defined in claim 36, wherein said packing film buffer is non-planar, said packing film buffer including an incline of an angle of about 15–45°.

* * * * *